United States Patent [19]

Kahrs

[11] Patent Number: 4,770,616

[45] Date of Patent: Sep. 13, 1988

[54] VARIABLE VANE-TYPE PUMP

[75] Inventor: Manfred Kahrs, Wiesbaden, Fed. Rep. of Germany

[73] Assignee: ITT Industries, Inc., New York, N.Y.

[21] Appl. No.: 550,609

[22] Filed: Nov. 10, 1983

[30] Foreign Application Priority Data

Nov. 20, 1982 [DE] Fed. Rep. of Germany ..... 3242983

[51] Int. Cl.[4] ..... F04C 15/04

[52] U.S. Cl. ..... 418/26; 418/27; 418/102

[58] Field of Search ..... 418/24–27, 418/29–31, 102

[56] References Cited

U.S. PATENT DOCUMENTS

| | | | |
|---|---|---|---|
| 2,236,556 | 4/1941 | Wunderle | 418/31 |
| 2,651,994 | 9/1953 | DeLancey et al. | 418/30 X |
| 2,724,339 | 11/1955 | O'Connor et al. | 418/26 X |
| 2,742,861 | 4/1956 | O'Connor et al. | 418/102 X |
| 2,788,671 | 4/1957 | Talbot | 418/27 |
| 3,373,692 | 3/1968 | Klessig et al. | 418/27 |
| 3,918,855 | 11/1975 | Bornholdt | 418/31 X |

*Primary Examiner*—Carlton R. Croyle
*Assistant Examiner*—T. Olds
*Attorney, Agent, or Firm*—James B. Raden; Robert P. Seitter

[57] ABSTRACT

A variable vane-type pump in which a cam ring with variable eccentricity encompasses a rotary piston comprising vanes guided in radial slots. At least one lateral surface of the rotary piston abuts on the contact surface of a control disc with pressure pocket and suction pocket. A channel is provided in the control disc whose intake opening is disposed in the direction of rotation of the pump between pressure pocket and suction pocket and in direct vicinity of the end of the pressure pocket. The channel terminates in a housing chamber, the waste oil chamber, the lubricating channels and/or into the under-vane chambers. After displacement of the cam ring, a connection can be established between the channel and the pressure pocket so that the pressure fluid still delivered can discharge via the channel to safeguard lubrication of the pump.

2 Claims, 2 Drawing Sheets

VARIABLE VANE-TYPE PUMP

BACKGROUND OF THE INVENTION

The present invention relates to a variable displacement pump, wherein a cam ring slidable in the pump housing and having variable eccentricity encompasses a rotary piston comprising vanes guided in radial slots. The vanes slide with their head ends at the cam ring, while a discoid annular control disc is interposed between the pump housing containing the inlet and the outlet and the rotary piston accommodated in the pump housing. The control disc includes control slots which correspond with compartments formed between the cam ring, the vanes and the rotary piston and the undervane chambers, and with the inlet and outlet.

A variable rotary displacement pump is known (German printed and published patent application No. 20 12 536), in which the cam ring is held in the pump housing slidable alongside a supporting surface by means of an adjusting spindle for the purpose of controlling the delivery. It is a disadvantage of this pump that thereis no possibility for precise adjustment of zero delivery, to the effect of precluding any creep rotation of the hydromotor connected to the pump.

It is likewise known to insert short-circuit valves into the pressure lines for the hydromotor by which complete standstill of the hydromotor can be accomplished. However, like devices are comparatively costly and increase the space required for the pump aggregate.

SUMMARY OF THE INVENTION

It is a major object of the present invention to produce a variable rotary displacement pump which is adjustable to an absolute zero delivery of the pump without there being a need for additional valves. Further, the present invention ensures lubrication of the rotary piston between the contact surfaces of the control disc while confining it laterally during the adjustment of zero delivery, so that special backing pumps can be dispensed with.

This major object is achieved according to the present invention in that the control disc is equipped with a channel which terminates in the contact side of the control disc and also in the housing chamber provided between a cam plate and the housing inner wall or in any other chamber of low pressure. The intake port of the channel is located in the direction of rotation of the pump between the pressure pocket and the suction pocket and in the direct vicinity of the pressure pocket.

In this arrangement, the distance between the intake port of the channel provided in the control disc and the end of the pressure pocket will preferably amount to about the thickness of one vane.

For the purpose of zero delivery, the cam ring is slidable within the housing chamber in relation to the control disc for a distance until the intake port of the channel on the contact side of the control disc moves into the area of the discharge compartment, and the pressure fluid delivered flows off into the intake port.

BRIEF DESCRIPTION OF THE DRAWING

A preferred embodiment of the invention is illustrated schematically in the accompanying drawings. In the drawings.

DETAILED DESCRIPTION

Figure 2:
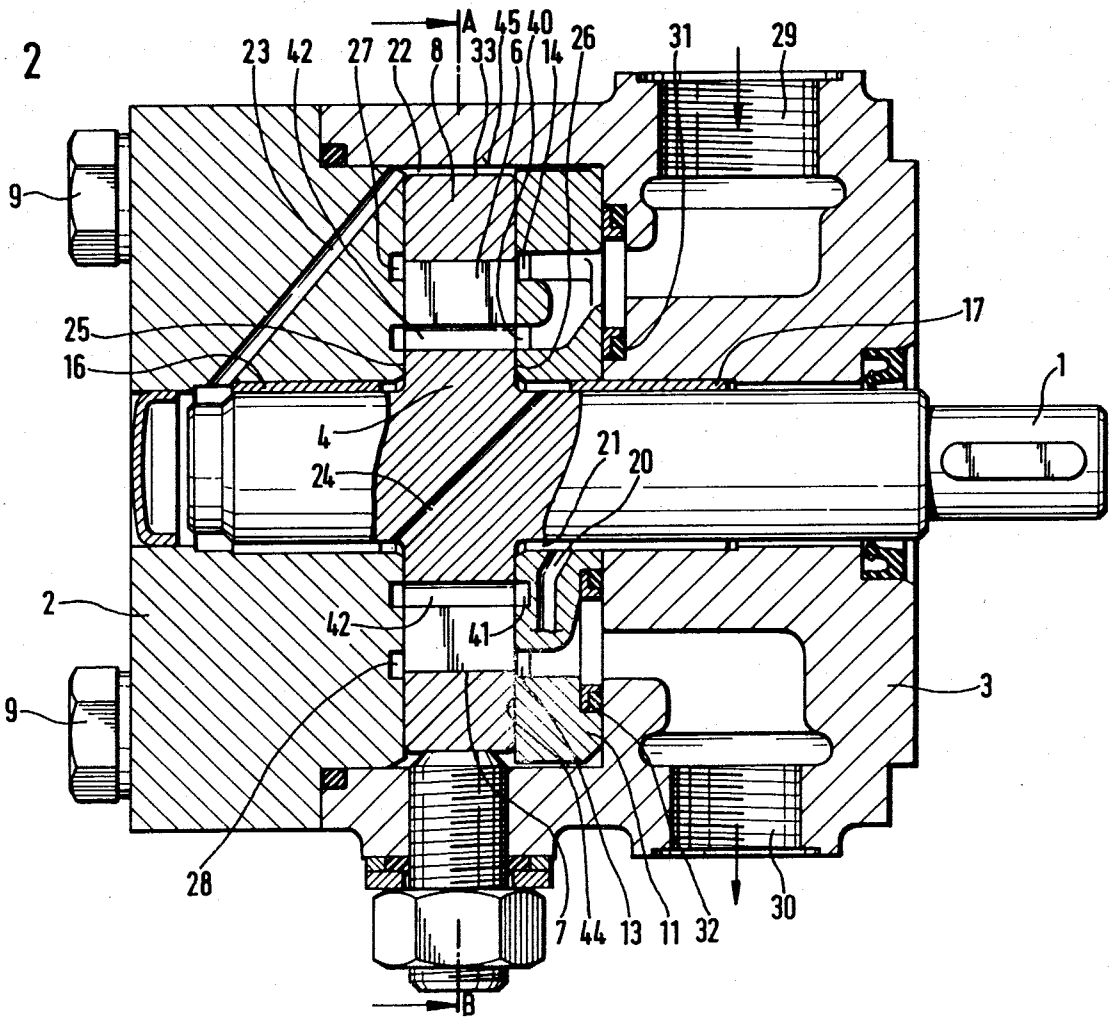
FIG. 2 is a longitudinal sectional view of the pump of FIG. 1.

The shaft 1 (shown best in FIG. 2) is supported rotatably in the housing 3 and in the cover 2 which closes the housing 3. Rigidly connected to said shaft 1 is the rotary piston 4 in whose radial slots 5 the vanes 6 are guided. Preferably, the shaft 1 and the rotary piston 4 can be of integral design. When the shaft 1 is driven, the ends of the vanes 6 that project from the slots 5 will slide on the circular track 7 of the slidably supported cam ring 8. The cam ring 8 is displaceable in relation to the control disc 11. The housing closure screws 9 are preferably located on the cover side of the pump assembly. These screws or bolts generate a tight sealing effect on the pressurized chambers in relation to the housing chamber 22.

The control disc 11 and the cover 2 are provided with pressure pockets 13 and 28 and suction pockets 14 and 27, respectively, through which the pressure fluid will be sucked into the compartments 10, 15, . . . and to pressure pockets 13 and 28 from which the pressure fluid will be forced. Reference numeral 29 designates the pressure fluid inlet which is contained in the housing 3, while reference numeral 30 is assigned to the pressure fluid outlet. Reference numerals 31 and 32 designate sealing rings which prevent the flow back of pressure fluid from the outlet 30 to the inlet 29 directly between the gaps which the control disc 11 forms with the inner wall of the housing 3. With its cylindrical peripheral surface 33, the cam ring 8 takes support on the end faces of two screws 34 and 35 screwed in the housing 3, while it is held in opposition to the force of the spring 39 (on screw 34) by the bracket 38 supported by threaded spindle 37 in the housing portion 36.

Figure 1:
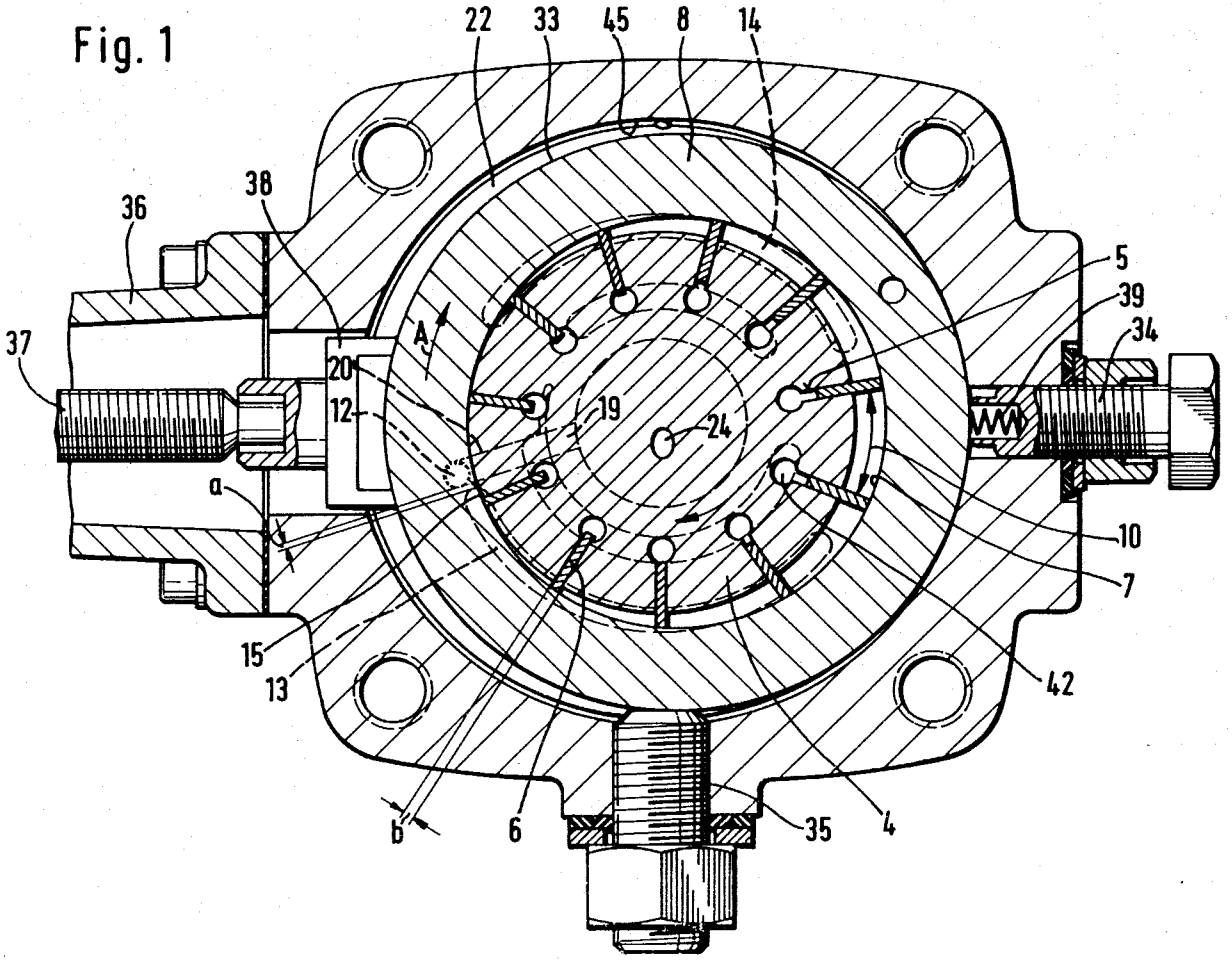
FIG. 1 is a cross-section taken through the pump in the area of the cam ring transversely to the longitudinal axis of the rotary piston along the lines A–B of FIG. 2, with the control pockets and the intake port being indicated in broken lines.

The control disc 11 of the pump which has formed in one face thereof the compartments 40 established by rotary piston 4, vanes 6 and cam ring 8. The disc contains a channel 12, 19, 20 on the face adjacent contact side 44 of the rotary piston (for the purpose of discharge of pressure oil and simultaneously for supplying rotary piston 4 and shaft bearings 16 and 17 with lubricating oil in the condition of zero delivery and close to this state, respectively). This channel is positioned such that its intake port 12 is closed by the cam ring 8 in the state of normal delivery and will be released and thus partially opened only upon displacement of the cam ring 8 into a position close to the condition of zero delivery. Consequently, (when viewed in the direction of rotation of the pump as indicated by the arrow A of FIG. 1) the intake port 12 has to be placed between the pressure pocket 13 and the suction pocket 14 of the control disc 11 at a distance from the center which results from the position of the cam ring 8 in the state of zero delivery of the pump. The distance (a) of the intake port 12 of the channel 19, 20 from the end of the pressure pocket 13 should be about the thickness of one vane (b) to the end that the pressure pocket 13 is in almost permanent communication with the channel 12, 19, 20 in the event of zero delivery via the compartment 15 projecting from it. Due to the design of the control disc 11, the channel 12, 19, 20 is connected to the housing chamber 22 of the pump (also for the purpose of attaining lubrication of rotary piston 4 and shaft bearings 16, 17 within the bore of the control disc 11 close to the bearings) most suitably through a second bore (not illustrated) meeting the channel 19, 20.

To describe the mode of operation, the cam ring 8 has to be contemplated as being almost in a centric position relative to the axis of the rotary piston, when close to the condition of zero delivery of the pump. At that time, the described intake port 12 on the face of the control disc adjacent the contact side 44 of the rotary piston will be partially opened and in communication with the compartment 15 projecting from the pressure pocket 13. As this compartment 15 will then be in communication with the pressure pocket 13, the pump will not deliver fluid into the pressure pocket 13, even in the event of low eccentricity of the rotary piston. Instead, the pump will deliver via the channel 12, 19, 20 into the housing chamber 22 and into the waste oil lines 23, 24 as a result of which the hydraulic motor will not longer be acted upon by oil flow and will not be driven. Due to the location of the intake port 12, the subsequent channel 19, 20 discharges near a bearing 17; both shaft bearings 16, 17 of the pump and the end surfaces 25, 26 of the rotary piston 4 will simultaneously be supplied with lubricating oil-via a waste oil line 24 in the shaft 1. During pressureless operation of the pump in the condition of zero delivery, no such supply of lubricating oil would be provided without the present invention.

What I claim is:

1. A variable displacement pump, of the type in which there is: a cam ring slidable in the pump housing surrounding a rotary piston comprising vanes guided in radial slots, in which the vanes slide with their head ends at the cam ring, a discoid annular control disc interposed between the pump housing containing the inlet and the outlet and the rotary piston accommodated in the pump housing, said control disc including control slots which communicate with the compartments formed between the cam ring, the vanes and the rotary piston and the under-vane chambers and correspond with the inlet and outlet, said control slots including angularly spaced apart pockets including a suction pocket adjacent the inlet and a pressure pocket adjacent said outlet, the invention in which the control disc is equipped with a channel which terminates at one end in the contact side of the control disc and at the other end in a low pressure chamber provided between the cam ring and the housing inner wall, and in which the intake port of the channel is located, when viewing in the direction of rotation of the pump, between the pressure pocket and the suction pocket directly adjacent to the pressure pocket, in which the distance between the intake port of the channel in the control disc and the end of the pressure pocket is approximately equal to the thickness of one vane, and wherein the cam ring is slidable within the housing chamber in relation to the control disc until the intake opening of the channel at the contact side of the control disc moves into the area of the pressure pocket and the pressure fluid delivered flows off via the intake port into the channel.

2. A variable displacement pump as claimed in claim 1 in which the cam ring is slidable within the housing chamber in relation to the control disc until the intake opening of the channel at the contact side of the control disc moves into the area of the pressure pocket and the pressure fluid delivered flows off via the intake port into the channel.

* * * * *